US007617912B2

(12) United States Patent
Henneau et al.

(10) Patent No.: US 7,617,912 B2
(45) Date of Patent: Nov. 17, 2009

(54) METHOD AND APPARATUS FOR OPERATING AN ELEVATOR SYSTEM

(75) Inventors: Philippe Henneau, Zurich (CH); Carlos Yankelevich, Ponte Capriasca (CH); Christoph Liebetrau, Menziken (CH)

(73) Assignee: Inventio AG, Hergiswil NW (CH)

( * ) Notice: Subject to any disclaimer, the term of this patent is extended or adjusted under 35 U.S.C. 154(b) by 379 days.

(21) Appl. No.: 11/623,898

(22) Filed: Jan. 17, 2007

(65) Prior Publication Data

US 2007/0181376 A1 Aug. 9, 2007

(30) Foreign Application Priority Data

Jan. 17, 2006 (EP) ..... 06100453

(51) Int. Cl.
*B66B 1/34* (2006.01)

(52) U.S. Cl. ..... 187/393; 187/254

(58) Field of Classification Search ..... 187/247, 187/254, 266, 391–394
See application file for complete search history.

(56) References Cited

U.S. PATENT DOCUMENTS

| | | | | |
|---|---|---|---|---|
| 1,866,911 | A * | 7/1932 | Schroeder | 226/193 |
| 3,497,787 | A | 2/1970 | Fuelster et al. | |
| 5,070,967 | A * | 12/1991 | Katzy et al. | 187/297 |
| 5,120,023 | A * | 6/1992 | Kawabata | 254/275 |
| 5,836,343 | A * | 11/1998 | Jones | 137/355.26 |
| 6,089,355 | A * | 7/2000 | Seki et al. | 187/292 |
| 6,305,499 | B1 | 10/2001 | Jones et al. | |

FOREIGN PATENT DOCUMENTS

| | | |
|---|---|---|
| DE | 2136540 A1 | 7/1971 |
| JP | 01 176624 A | 7/1989 |
| JP | 07 010402 A | 1/1995 |

* cited by examiner

*Primary Examiner*—Jonathan Salata
(74) *Attorney, Agent, or Firm*—Fraser Clemens Martin & Miller LLC; William J. Clemens

(57) ABSTRACT

A method of operating an elevator system with a drum for taking up a suspension device, a drive unit for driving the drum, and a control unit for controlling the drive unit, includes operating the control unit of the drive unit to prescribe a rotational speed that depends on a length of the suspension device that is rolled onto the drum. Also included is an elevator system in which the method can be used.

12 Claims, 3 Drawing Sheets

State of the Art

METHOD AND APPARATUS FOR OPERATING AN ELEVATOR SYSTEM

BACKGROUND OF THE INVENTION

The present invention relates to a method of operating an elevator system, and an elevator system in which this method can be used.

Usually, elevator systems are used in which the elevator car is raised and lowered by means of a rope. Typically used as rope is a steel suspension rope that runs over a rope sheave and at one of its ends is connected to the elevator car and at its other end to a counterweight. The rope sheave is driven by an electric motor, the rope sheave raising the elevator car when the motor turns in one direction, and the rope sheave lowering the elevator car when the motor turns in the other direction. Between the drive motor and the rope sheave, a reduction gear can be provided. Typically, the drive motor is also provided with a control unit. The rope sheave, the drive motor, and a control system are usually arranged in a machine room above the elevator hoistway.

The elevator car and the counterweight hang on mutually opposite sides of the rope sheave. The weight of the counterweight usually corresponds approximately to the weight of an elevator car that is 40% full. If the elevator car is 40% full, the result is that only little energy is needed to move the elevator car. In such a case, the drive motor serves mainly to overcome friction. If the weight of the elevator car is approximately equal to the weight of the counterweight, this results in an approximately constant level of potential energy in the overall system. When the potential energy of the elevator car falls as a result of the elevator car being lowered, the potential energy of the counterweight increases correspondingly as a result of its being raised, and vice versa.

This normally used elevator system has the disadvantage that additional building space is required for the counterweight. Also, the moment of inertia of the counterweight can cause undesired positional changes of the elevator car.

These disadvantages can, however, be avoided by the rope, or a corresponding means of suspension, being wound around a drum that is provided for this purpose, instead of passing over a rope sheave and being connected on the other side to a counterweight. Such an elevator system is known from German patent application 2136540. Known from this application is an elevator system with a drive drum in which the suspension belt that is used as a suspension means is stored. The arrangement of a counterweight can thereby be obviated. The suspension belt is driven by positive engagement and does not depend on higher coefficients of friction between the suspension belt and the drive drum.

From U.S. Pat. No. 6,305,499 B1 an elevator system is known that also has a drum on which the suspension means is rolled so that a counterweight can be obviated. The drum is arranged in the elevator hoistway. The suspension means is fastened to a wall of the elevator hoistway, runs over two rope sheaves that are arranged on the elevator car, and is rolled onto the drum through an opening in another hoistway wall.

Since in the known elevator system with drum, the suspension means is rolled onto the drum at a constant rotational speed, the speed of the elevator car changes depending on the length of the suspension means already rolled onto the drum. As the elevator car rises, the suspension means is rolled onto the drum, as a result of which the diameter of the roll of suspension means on the drum continually increases, which in its turn results in an increase in the speed of the car. When the elevator car travels down, the diameter of the roll of suspension means decreases, with the consequence that the speed of the elevator car reduces. If the speed of rotation of the drive unit is constant, the speed of the elevator car thus depends on the position of the elevator car. This results in a low level of comfort for the user.

SUMMARY OF THE INVENTION

It is a task of the present invention to create a method of operating an elevator system with a drum for uptake of a suspension means whose use results in a high level of comfort for the user. It is a further task of the present invention to provide an elevator system that is particularly suitable for use of the method according to the present invention.

The present invention solves the task by providing a method wherein a speed of rotation of the drive unit that serves to drive the drum is defined by a control unit that serves to control the drive unit depending on a length of the belt that is rolled onto the drum. The control unit can also be a feedback control unit.

The method according to the present invention has the advantage that the speed of rotation of the drive unit is defined by the control unit in such manner that the speed of the elevator car is essentially constant. This is experienced by the passenger as pleasant, and results in an increase in comfort for the user. Since the drum takes up the suspension means, a counterweight can be dispensed with. By this means, slipping effects resulting from the moment of inertia of the counterweight are avoided. The position of the elevator car can be determined from the length of the suspension means rolled onto the drum.

In a first embodiment of the present invention, the length of the suspension means that is rolled onto the drum is determined from an absolute number of turns of the drum. The absolute number of turns of the drum is to be understood as the difference between the number of turns of the drum when raising the elevator car and the number of turns of the drum when lowering the car. The length of the suspension means that is rolled onto the drum and/or the absolute number of turns is preferably determined by a value encoder that is assigned to the drive unit and which may particularly be an impulse encoder and/or a rotational speed encoder. Additionally, or alternatively, the length of the suspension means that is rolled onto the drum and/or the absolute number of turns from a position of the elevator car in an elevator hoistway can be determined by a value encoder, particularly a positional value encoder, that is arranged in the elevator hoistway or on the elevator car.

In a further development of the present invention, after each turn of the drum, a rotational speed is prescribed by the control unit. A turn of the drum is to be understood as a complete turn, in other words a turn through 360°. This has the advantage that the rotational speed of the drive unit is adapted to the length of suspension means that is rolled onto the drum as nearly as possible in real time.

In a further embodiment of the present invention, the suspension means is rolled onto the drum spirally. This means that on each turn, the suspension means comes to rest on itself. The segments of the suspension means that form a turn do not come to rest on the drum side by side. This has the advantage that essentially the width of the drum need only be the same as the width of the suspension means.

The elevator system according to the present invention is characterized in that a control unit for controlling the drive unit is provided that is executed in such manner that it can determine a rotational speed of the drive unit from the length of suspension means that is rolled onto the drum. This has the advantage that by adaptation of the rotational speed of the drive unit, the speed of the elevator car can be held essentially constant.

To determine the number of turns, a value encoder that is assigned to the drive unit and/or a value encoder that is assigned to the elevator car and/or to the elevator hoistway can be used, the value encoder serving to determine the position of the elevator car in the elevator hoistway, from which, in turn, the number of turns can be determined.

Preferably, absolute encoders are used that need no initialization, with which the elevator car is moved into a starting position and the control unit sets the absolute number of turns to zero. An absolute value encoder stores, for example, an absolute number of turns already executed during commissioning as also a number of turns executed after a power outage.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

In the figures, identical reference numbers indicate functionally identical components.

Figure 1:
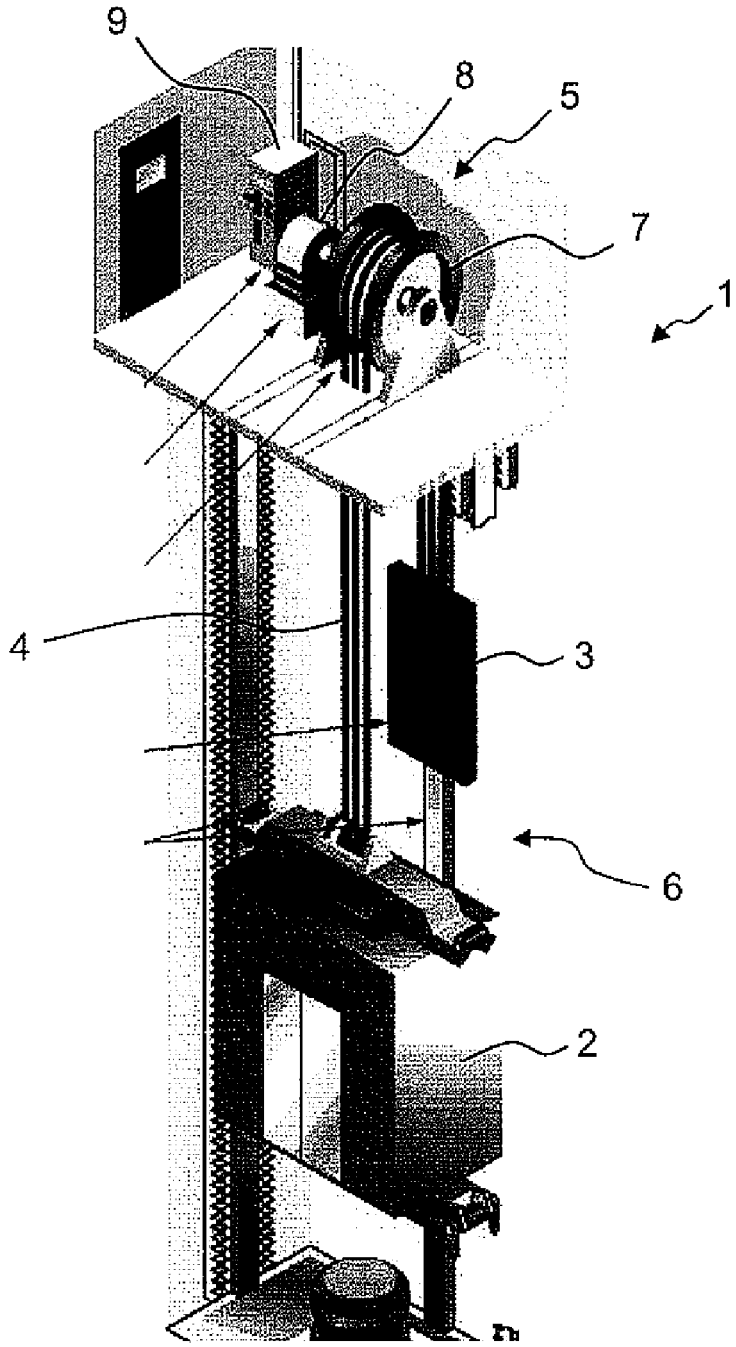
FIG. 1 is a perspective view of a prior art elevator system with a counterweight.

FIG. 1 shows a prior art elevator system 1 as it is normally used. The elevator system 1 comprises an elevator car 2, a counterweight 3, a suspension means 4, and a machine room 5 that is arranged above an elevator hoistway 6. Used as the suspension means 4 is, for example, a rope, a belt, or a flat belt. The suspension means 4 is connected at one of its ends to the elevator car 2 and at its other end to the counterweight 3, and passes over a rope sheave 7 that is arranged in the machine room 5. The rope sheave 7 is driven by a drive unit 8, for example an electric motor, that is in turn controlled by a control unit 9.

Figure 2:
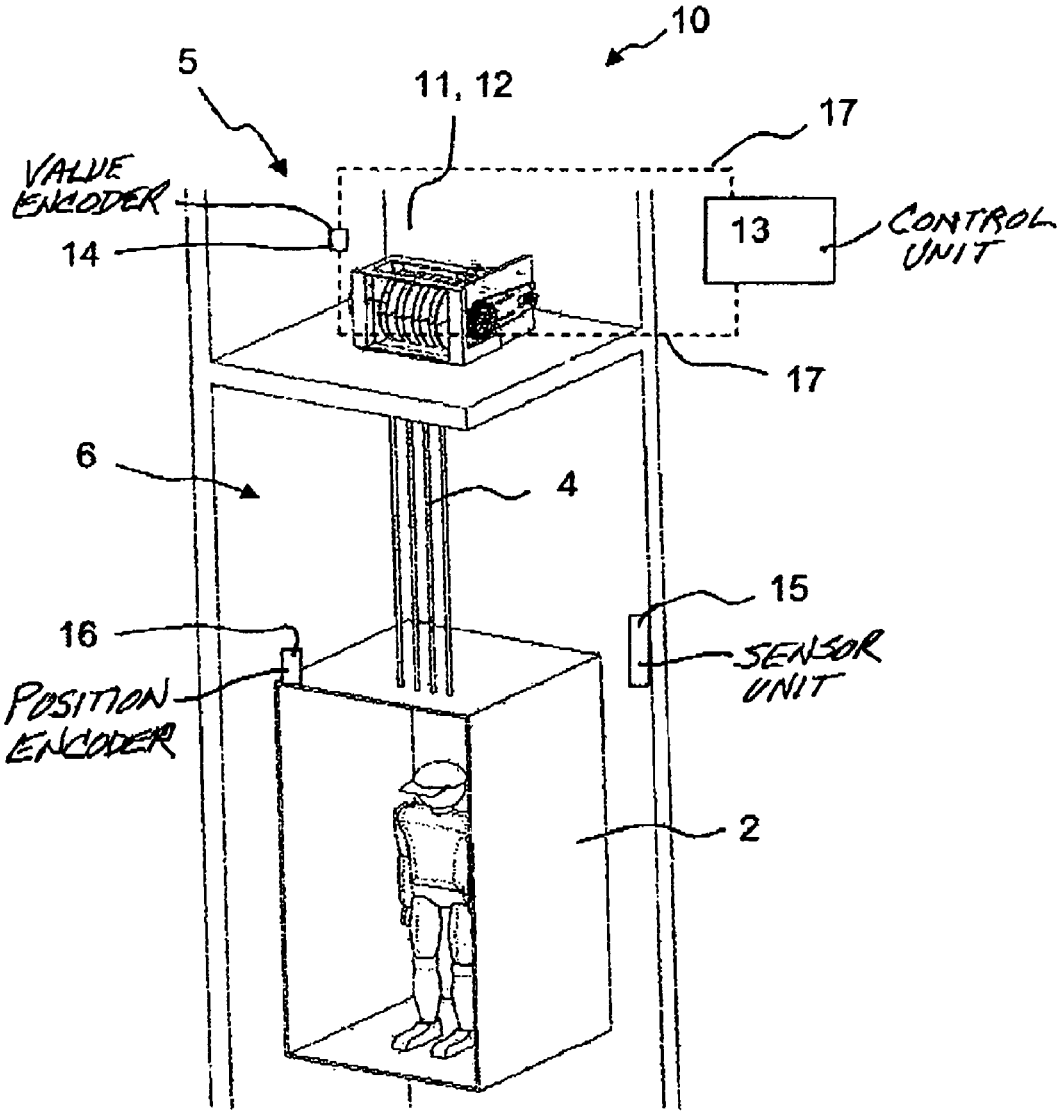
FIG. 2 is a perspective schematic representation of an elevator system with a drum to take up a suspension means according to the present invention.

For the counterweight 3, additional building space is required. To save this building space, in an elevator system 10 according to the present invention as shown in FIG. 2, a drum 11 is used that is preferably arranged in the machine room 5 and onto which the suspension means 4 can be rolled. The suspension means 4 can consist of several suspension means that run in parallel. Assigned to the drum 11 is a drive unit 12, the drum 11 and the drive unit 12 being preferably integrated into a unit. The drive unit 12 is controlled by a control unit 13.

Figure 3:
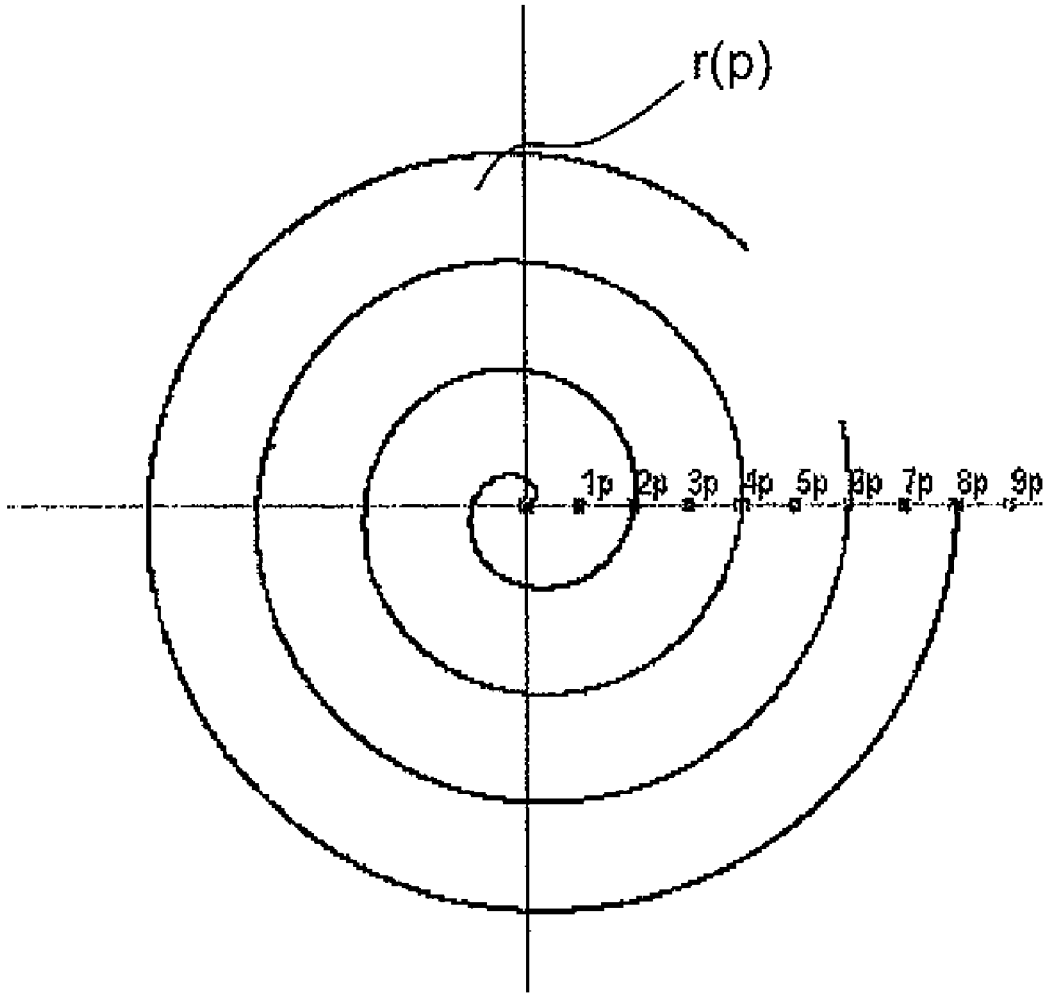
FIG. 3 is a schematic representation of an Archimedean spiral.

The suspension means 4 is rolled onto the drum 11, preferably in the form of a so-called Archimedean spiral r(p) as shown exemplarily in FIG. 3. An Archimedean spiral is characterized by a constant distance between turns over its entire defined area. In the elevator system that is represented in FIG. 2, this constant distance between turns results from the constant thickness of the suspension means 4.

In the elevator system 1 according to FIG. 1 in which the suspension means 4 is only diverted once over the rope sheave 7, and in which the rope sheave has a known and constant diameter "D", the control unit 9 determines from a reference speed "S" a rotational speed "R" of the drive unit 8, preferably in the unit revolutions per minute, according to the following formula, $$R(s) = \frac{S}{D\pi},$$

where π is the constant 3.1416.

In the elevator system 10 according to FIG. 2, in which the suspension means 4 is rolled onto the drum 11, calculation of the rotational speed according to this formula would, however, have the effect that with decreasing height the elevator car would fall at ever decreasing speed, and with increasing height would rise at ever increasing speed. To avoid this change in the car speed, in the method according to the invention, when determining the rotational speed "R", the length of suspension means 4 that is rolled onto the drum 11 is taken into account.

The length of an Archimedean spiral r(p), as illustrated in FIG. 3, is calculated according to the following formula:

$$L = \frac{1}{2}a\left(p\sqrt{1+p^2} + \ln\left(p + \sqrt{1+p^2}\right)\right), \text{ where } p = 2n\pi,$$

where "a" is the thickness of the suspension belt 4, "n" is the absolute number of turns of the drum, and "p" is the angle in the plane polar coordinate system in which the spiral lies. Taking into account the diameter "D" of the drum 11, the length of the spiral $$L = L1 - L2$$

where $$L1 = \frac{1}{2}a\left(p\sqrt{1+p^2} + \ln\left(p + \sqrt{1+p^2}\right)\right) \text{ where } p = \left(\frac{D/2}{a} + n\right)2\pi,$$

and $$L2 = \frac{1}{2}a\left(q\sqrt{1+q^2} + \ln\left(q + \sqrt{1+q^2}\right)\right) \text{ where } q = \left(\frac{D/2}{a}\right)2\pi.$$

The rotational speed "R" is preferably newly defined after each turn of the drum 11. For this new definition of the rotational speed, the length or segment of the suspension means 4 must be taken into account that was rolled onto the drum 11 during the last turn. This rolled-on length per turn "Z" is given by Z=Z1−Z2 where $$Z1 = \frac{1}{2}a\left(p\sqrt{1+p^2} + \ln\left(p + \sqrt{1+p^2}\right)\right) \text{ where } p = \left(\frac{D/2}{a} + n\right)2\pi,$$

and $$Z2 = \frac{1}{2}a\left(q\sqrt{1+q^2} + \ln\left(q + \sqrt{1+q^2}\right)\right) \text{ where } q = \left(\frac{D/2}{a} + m\right)2\pi,$$

where m=n−1 and m=0 when n<1.

The control unit 13 then determines the rotational speed "R" of the drive unit 12 for the drum 11 from a predefined reference speed "S" that is divided by the rolled-on length "Z"

of the suspension means 4 per turn of the drum 11 according to the following formula $$R(s, n) = \frac{S}{N}$$

and thereby prescribes the rotational speed "R" that is obtained to the drive unit 12. The reference speed "S" can, for example, be prescribed by the user or by the supplier of the elevator system.

The control unit 13 controls the drive unit 12 and thereby the drum 11 to the prescribed rotational speed "R". The control unit 13 can be executed so that it regulates the drive unit 12 and/or the drum 11 to the prescribed rotational speed "R".

The length "Z" depends on the absolute number "n" of turns since commissioning. To determine this absolute number "n" of turns, a value encoder 14, preferably an impulse encoder, can be provided on the drive unit 12 and/or on the drum 11. To initialize the value encoder 14, the elevator car can be caused to travel to a starting position which may be, for example, the bottommost story, and the control unit 13 resets the absolute number "n" of turns to zero. A sensor unit 15 can be provided, that is provided in the elevator hoistway 6 and that is preferably based on a magnetic measuring principle, that communicates to the control unit 13 when the elevator car 2 has reached the starting position.

The absolute number "n" of turns can also be determined from the position of the elevator car 2 in the elevator hoistway 6. For this purpose, it is preferable for a position encoder 16 to be arranged in the elevator hoistway 6 and/or on the elevator car 2. This must also be initialized according to the principle described. From the determined position of the elevator car 2, that results in turn from the length of the rolled-on suspension means 4, the control unit 13 then determines the absolute number "n" of turns of the drum 11.

To avoid the initialization, the value encoders 14 and/or 16 can also be executed as absolute value encoders that have stored the absolute number "n" of rotations that, for example, were already executed during commissioning, or after a power outage.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator system with a drum for taking up a suspension means, a drive unit for driving the drum, and a control unit for controlling the drive unit, comprising the steps of:

a. generating from the control unit a signal representing a rotational speed that depends on a length of the suspension means that is rolled onto the drum; and b. operating the drive unit at the rotational speed in response to the signal.

2. The method according to claim 1 including determining the length of the suspension means that is rolled onto the drum from an absolute number of the turns of the drum.

3. The method according to claim 2 including determining absolute number of turns from a position of an elevator car attached to the suspension means in an elevator hoistway.

4. The method according to claim 1 including determining the length of the suspension means that is rolled onto the drum from a position of an elevator car attached to the suspension means in an elevator hoistway.

5. The method according to claim 1 including during commissioning of the elevator system initializing the control unit when the elevator car is moved into a starting position.

6. The method according to claim 1 performing said step a. after each turn of the drum.

7. The method according to claim 1 including rolling the suspension means onto the drum spirally in an Archimedean spiral.

8. An elevator system comprising:

a drum for taking up a suspension means attached to an elevator car;

a drive unit for driving said drum in rotation; and a control unit for controlling the rotation of said drive unit, said control unit operating to determine a rotational speed for said drive unit that depends on a length of said suspension means that is rolled onto said drum.

9. The elevator system according to claim 8 including a value encoder connected to said drive unit for determining a number of turns of said drum.

10. The elevator system according to claim 9 wherein said value encoder is an absolute value encoder.

11. The elevator system according to claim 8 including a value encoder attached to the elevator car for determining a position of the elevator car.

12. The elevator system according to claim 11 wherein said value encoder is an absolute value encoder.

* * * * *